US007559164B1

(12) United States Patent
Riehlman et al.

(10) Patent No.: US 7,559,164 B1
(45) Date of Patent: Jul. 14, 2009

(54) FOOTBALL DOWN MARKER

(75) Inventors: Royce Riehlman, 5901 Kendrew Dr., Port Orange, FL (US) 32127; Larry Downes, Ormand Beach, FL (US); Brandon Taylor, 147 S. Shadow Breeze Rd., Kaysville, UT (US) 84037; Mike Bazzano, Kaysville, UT (US)

(73) Assignees: Royce Riehlman, Port Orange, FL (US); Brandon Taylor, Kaysville, UT (US)

( * ) Notice: Subject to any disclaimer, the term of this patent is extended or adjusted under 35 U.S.C. 154(b) by 176 days.

(21) Appl. No.: 11/493,864

(22) Filed: Jul. 25, 2006

Related U.S. Application Data

(60) Provisional application No. 60/702,967, filed on Jul. 27, 2005.

(51) Int. Cl.
*A63B 71/06* (2006.01)

(52) U.S. Cl. ..... 40/598; 40/550; 473/490; 340/815.53

(58) Field of Classification Search ..... 40/598, 40/550; 473/490; 340/815.53
See application file for complete search history.

(56) References Cited

U.S. PATENT DOCUMENTS

| | | | | | |
|---|---|---|---|---|---|
| 2,064,745 | A | * | 12/1936 | Harrie | 33/759 |
| 2,549,627 | A | | 4/1951 | Musch et al. | |
| 3,086,307 | A | | 4/1963 | Greene | |
| 3,512,260 | A | | 5/1970 | Tomlinson et al. | |
| 3,728,708 | A | | 4/1973 | Culbertson | |
| 3,868,671 | A | | 2/1975 | Maguire et al. | |
| 4,404,543 | A | | 9/1983 | Kracl | |
| 4,837,957 | A | * | 6/1989 | Egender | 40/488 |
| 4,841,674 | A | * | 6/1989 | Smith | 40/491 |
| D304,844 | S | | 11/1989 | Smith | |
| 4,973,951 | A | * | 11/1990 | Shigeta et al. | 345/1.3 |
| 5,283,595 | A | * | 2/1994 | Krukovsky | 345/2.3 |
| 5,293,354 | A | | 3/1994 | Costabile | |
| 5,451,979 | A | * | 9/1995 | Levac | 345/82 |
| 5,532,677 | A | | 7/1996 | Miller | |
| 5,697,175 | A | * | 12/1997 | Schwartz | 40/552 |
| 5,964,051 | A | * | 10/1999 | Loeber et al. | 40/570 |
| 6,052,054 | A | | 4/2000 | Hampson et al. | |
| 6,065,233 | A | * | 5/2000 | Rink | 40/607.1 |
| 6,265,984 | B1 | | 7/2001 | Molinaroli | |
| 6,603,711 | B2 | | 8/2003 | Calace | |
| 6,833,796 | B2 | * | 12/2004 | Bourgault | 340/929 |
| 6,907,840 | B1 | | 6/2005 | Gaines | |
| 6,976,928 | B2 | * | 12/2005 | Hemphill | 473/490 |
| 7,031,225 | B2 | | 4/2006 | McDonald | |
| 7,185,439 | B1 | * | 3/2007 | Nubin et al. | 33/289 |
| 2003/0140536 | A1 | | 7/2003 | Bilyeu | |

OTHER PUBLICATIONS

"optoLEUM," http://web.archive.org/web/20030421013336/http://www.voltarc.com/LED_SignsOptoleum.htm, Apr. 21, 2003.*

"Price Changers," http://web.archive.org/web/20030402034806/www.mckaydata.com/price.changers.html, Apr. 2, 2003.*

"Gas Station Displays," http://web.archive.org/web/20030618105952/http://www.numeritex.com/gasstation.htm, Jun. 18, 2003.*

* cited by examiner

*Primary Examiner*—Gary C Hoge
(74) *Attorney, Agent, or Firm*—Thorpe North & Western LLP

(57) ABSTRACT

A down marker for use in a football game includes a vertical support and a display panel that extends from the vertical support. This display panel carries an array of solid state lighting devices configured to optically display a down number. The array of solid state lighting devices is selectively controlled by a controller that is carried by the down marker, in response to an external input.

19 Claims, 6 Drawing Sheets

FOOTBALL DOWN MARKER

CROSS-REFERENCE TO RELATED APPLICATIONS AND CLAIM OF PRIORITY

Priority is claimed of copending U.S. Provisional Patent Application Ser. No. 60/702,967, filed Jul. 27, 2005, which is hereby incorporated herein by reference in its entirety.

BACKGROUND

The present invention relates generally to football down markers. Football down markers are used in football games to signal to the players and fans the current "down" number; e.g., $1^{st}$, $2^{nd}$, $3^{rd}$ or $4^{th}$ down. The down marker is generally positioned on the sideline to both mark the line of scrimmage and to indicate the current down. Typically, a display panel is included near the top of the down marker that displays the current down number in a forward direction toward the field, and also in a reverse direction toward spectators in a stadium or on the sidelines of the field. Most conventional down markers include panels that indicate the current down, and the down information is changed by mechanically exposing one panel while mechanically concealing the previously exposed panel.

While such markers have found widespread acceptance, oftentimes spectators, especially those seated far from the down marker, can have a difficult time ascertaining which down number is being displayed by the down marker, particularly when the field being used has poor lighting conditions. Players or officials far removed from the line of scrimmage can at times also have difficulty determining the current down. This difficulty can cause confusion and/or misunderstanding both on and off the field of play.

To improve the collective understanding of down information for games on a field that has a scoreboard, the down information is often re-displayed on the scoreboard for fans and players to see. However, on occasions the down number displayed by the sideline official will differ from the number displayed on the scoreboard. This situation can confuse players, coaches, and fans, thus resulting in a delay of the game until the scoreboard and down marker can be reconciled.

SUMMARY

It has been recognized that it would be advantageous to develop a down marker that can be easily viewed from long distances and that aids in eliminating discrepancies between the line of scrimmage down marker and the scoreboard display.

Briefly, and in general terms, the invention is directed to a down marker for use in a football game, including a vertical support and a display panel, extending from the vertical support. An array of solid state lighting devices can be carried by the display panel, the array being configured to optically display a down number. A control can be associated with the down marker and can be operable to enable selective control of the solid state lighting devices of the array in response to external input.

In accordance with another aspect of the invention, a down marker for use in a football game is provided, including a vertical support and a display panel extending from the vertical support. An array of solid state lighting devices can be carried by the display panel, the array being configured to optically display a down in response to external input. A wireless communication device can be associated with the down marker and can be operable to transmit down information or game play information between the down marker and a scoreboard device to enable synchronization of down information or game play information between the down marker and the scoreboard device.

In accordance with another aspect of the invention, a method for displaying the current down in a football game is provided, including: illuminating a down marker display panel with current down information; electronically modifying the illuminated current down information in response to user input; and wirelessly communicating the current down information between the down marker and a scoreboard system to synchronize the scoreboard system and the down marker.

Reference will now be made to the exemplary embodiments illustrated, and specific language will be used herein to describe the same. It will nevertheless be understood that no limitation of the scope of the invention is thereby intended.

DETAILED DESCRIPTION OF EXEMPLARY EMBODIMENTS

The following detailed description of exemplary embodiments of the invention makes reference to the accompanying drawings, which form a part hereof and in which are shown, by way of illustration, exemplary embodiments in which the invention may be practiced. While these exemplary embodiments are described in sufficient detail to enable those skilled in the art to practice the invention, it should be understood that other embodiments may be realized and that various changes to the invention may be made without departing from the spirit and scope of the present invention.

Thus, the following more detailed description of the embodiments of the present invention, as represented in FIGS. 1*a* through 6, is not intended to limit the scope of the invention, as claimed, but is presented for purposes of illustration only and to sufficiently enable one skilled in the art to practice the invention. Accordingly, the scope of the present invention is to be defined solely by the claims.

In describing and claiming the present invention, the following terminology will be used.

The singular forms "a," "an," and "the" include plural referents unless the context clearly dictates otherwise. Thus, for example, reference to "a control" can include reference to one or more of such controls, and reference to "an array" can include reference to one or more of such arrays.

As used herein, the term "solid state lighting devices" refers to lighting devices that emit light from a solid material rather than from a vacuum or gas tube, as is the case with traditional incandescent light bulbs and fluorescent lamps. Solid state lighting devices utilized in the present invention include, without limitation, light emitting diodes, organic light emitting diodes, polymer light-emitting diodes, and other such devices.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Figure 1A:
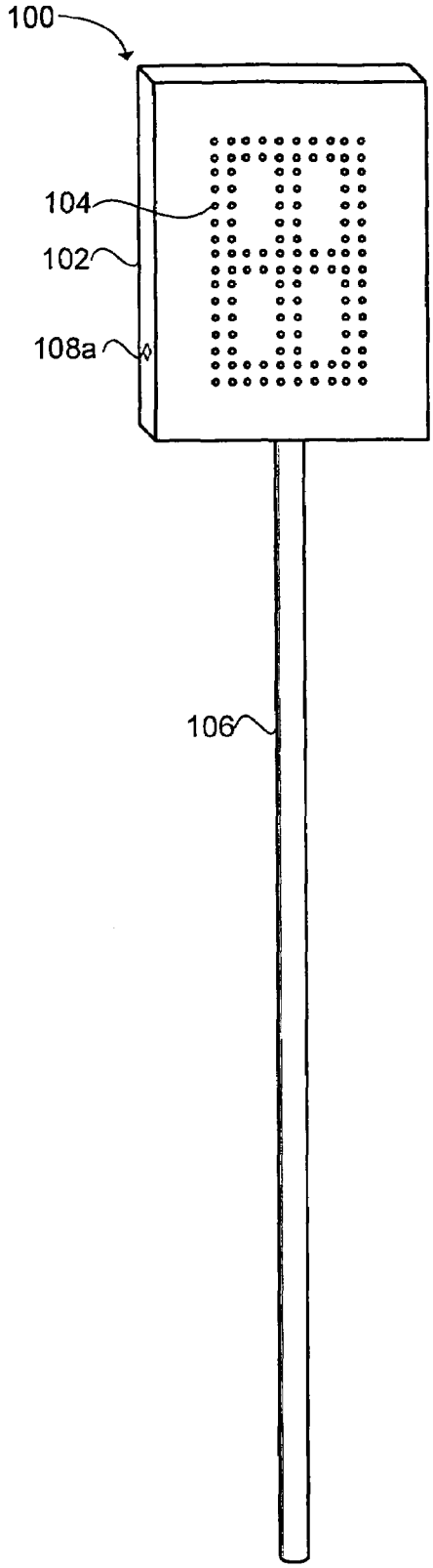
FIG. 1*a* is a front left perspective view of a football down marker in accordance with an embodiment of the present invention.
Figure 1B:
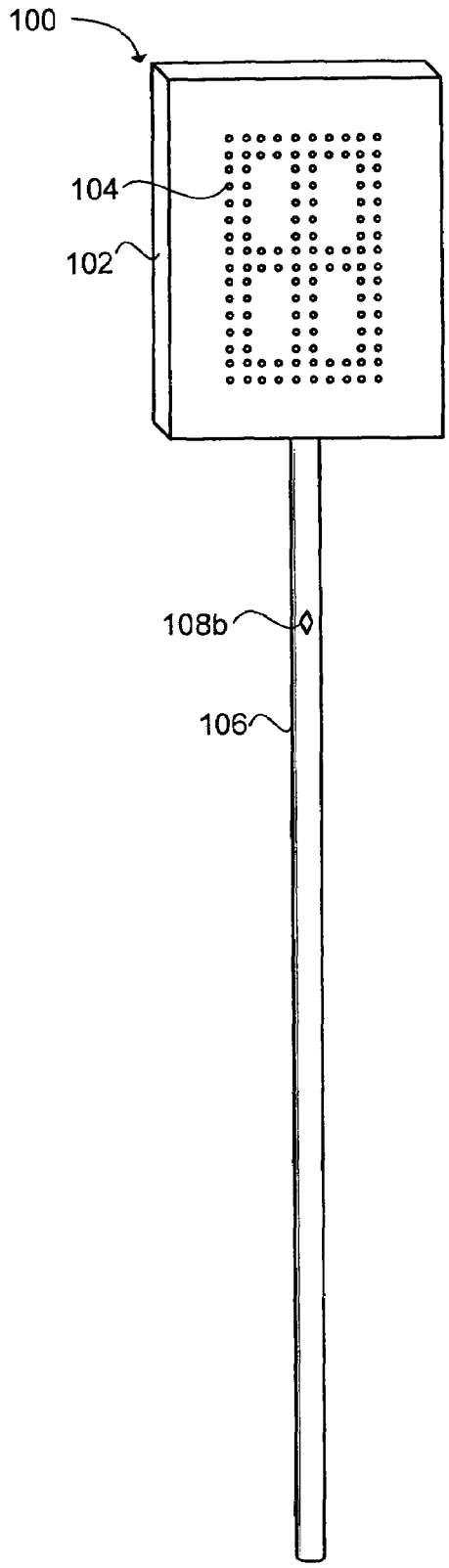
FIG. 1*b* is a front left perspective view of a football down marker in accordance with another embodiment of the present invention.

As illustrated in FIGS. 1*a*-1*b*, a down marker 100, in an example implementation in accordance with the invention, is positioned with a vertical support 106 oriented generally upright so as to position a display panel 102 in a location visible by spectators of a football game. While not so limited, the vertical support can have a length (or height, when upright) in the range of about 5 feet to about 8 feet. The display panel can extend from a portion of the vertical support 106. As shown, the display panel can extend from an upper portion of the vertical support. In other embodiments, however, the display panel can extend from a side portion or lower portion of the vertical support.

The display panel 102 can carry an array of solid state lighting (SSL) devices 104 that are configured to cooperatively optically display a down number. While not so limited, the down number displayed can typically be one of four digits: 1, 2, 3 or 4. A control (shown schematically at 203 in FIG. 2) can be carried by the down marker that can selectively modify the array of SSL devices in response to an external input. An external input can be received by the device via a unit, such as button or switch 108*a* associated with the display panel, or button or switch 108*b* associated with the vertical support. The external input can also be a wireless communication signal received by way of structure discussed in more detail below.

During a football game, a sideline official or other individual can grasp the vertical support 106 or display panel 102 to position the down marker in a generally upright position. Because of the nature of a football contest and the position of the down marker, the down marker components, such as the vertical support and display panel, can be made of a high impact plastic that is configured to withstand to the force of being impacted and/or knocked over. In one embodiment, this material can include, without limitation, copolymer polypropylene, high impact styrene, and/or polycarbonate, and derivatives and combinations thereof. The down marker can also include a padded covering (not shown) to protect the down marker and players from the impact of a collision.

Figure 2:
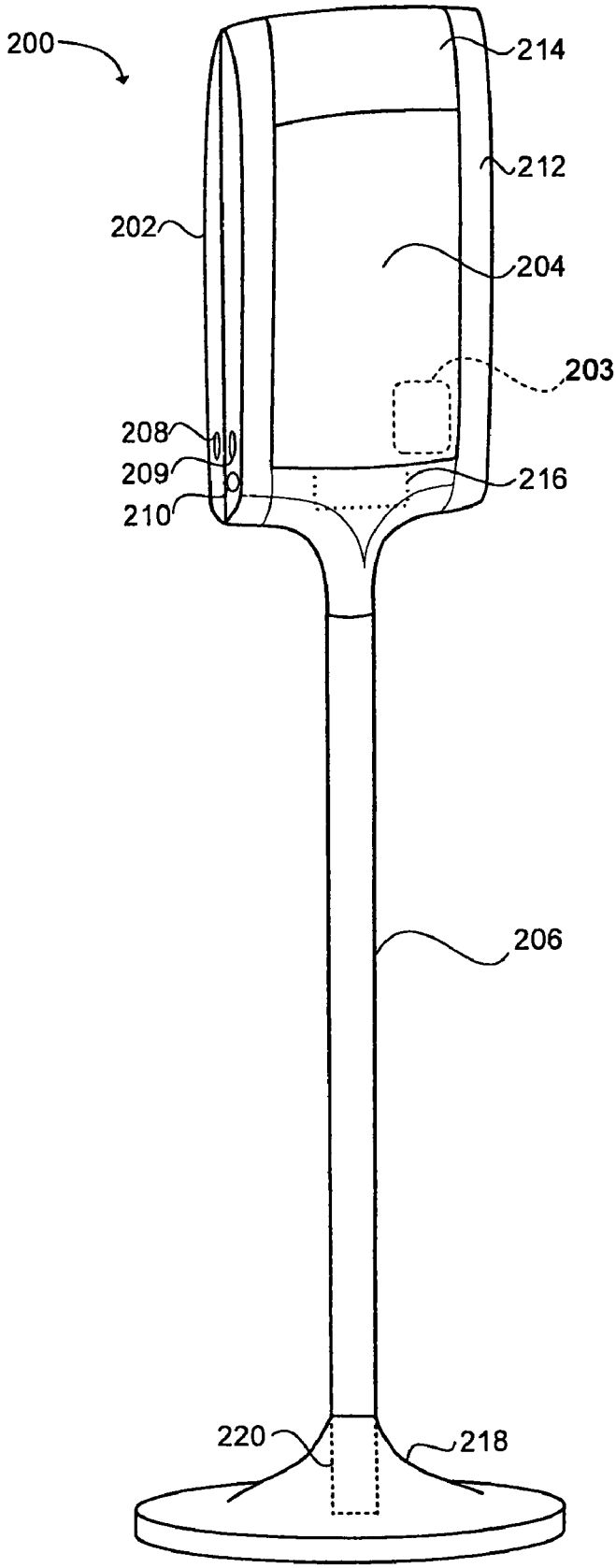
FIG. 2 is a front left perspective view of a football down marker in accordance with yet another embodiment of the present invention.

As shown in FIG. 2, in one embodiment of the invention, the down marker 200 can include a stand 218 that can hold the down marker in a freestanding upright position. A bore 220 can be included in the stand and can be sized and shaped to receive a bottom portion of the vertical support 206. In some instances it can be beneficial to include a weighted material in the stand that can stabilize the stand structure against wind and other forces that could topple the marker and stand. Thus, in one aspect of the invention, the stand can be a weighted stand with materials such as sand, concrete, relatively dense metals, etc. (none shown), included within the stand or on the stand to provide stabilization.

In addition, the bottom end of the vertical support 106 can include a spike portion (not shown) that can be driven or thrust into the ground so that the down marker can be positioned upright without the aid of a stand. A freestanding down marker, whether supported by a stand or spike, can eliminate the need for a sideline official to constantly attend the down marker.

In one embodiment of the invention, the display panel 202 can include several body segments. While not so limited, in one aspect of the invention, the height and width of the display panel can each range from about 6 inches to about 20 inches. In one embodiment, the display panel is sized about 9 inches in width and about 11 inches in height. A frame 212 can provide structural support to the display panel as well as providing a battery compartment 216 for placing and/or securing a battery or battery pack to power the SSL devices. The frame can also provide support for a front 204 and back (not shown) protective lens.

A top segment 214 can be coupled to the frame segment 212 and protective lenses 204 to retain the protective lenses in position. A logo, decal, or other design (not shown) can be included on the top segment, frame segment, vertical support, or protective lenses, and can be particularly well displayed and visible if positioned on top segment 214. An up 208 and down 209 button or switch can be included on the display panel, as well as an on/off button 210, and a battery recharge receptacle or antenna (not shown). The control can be carried in the display panel, as will be appreciated by one having ordinary skill in the art.

The array of SSL devices can protrude from or can be enclosed behind the protective lenses 204, as desired. A first array of SSL devices can be configured to face in a forward direction. A second array of SSL devices can be included with the invention that faces in an opposing, rearward direction. An opaque protective lens can intensify the SSL device light relative to ambient light to provide a display that it is more clearly visible. The protective lens can be a sheet of translucent or transparent plastic that is coupled to the display panel.

When the SSL device array is positioned behind the protective lens, the lens can be "tuned" to the color of the solid state lighting devices, so that the SSL device light can pass through the lens and be visible to both players and fans. A variety of SSL device colors, sizes, shapes, intensities, and types can be used. In one aspect of the invention, a commercially available acrylic plastic lens that has been coated or dyed to the approximate wavelength of the solid state devices is used as the protective lens. A variety of plastic or glass materials can be used, either coated or dyed, to accomplish this objective. The protective lens can be partially or fully opaque, or translucent to varying degrees. In general, the tuning process can be used to establish a "no-pass" filter that prevents or limits light of a particular wavelength from passing through the lense, or to establish a "pass filter" to allow light of a particular wavelength to pass through the lens.

In addition to "tuning" the protective lens to optimize the visual clarity of the lighting devices, the background immediately adjacent the lighting devices can be varied in color or appearance to provide optimal contrast with the lighting devices. In this manner, spectators or fans viewing the down marker can more easily distinguish the down being indicated by the lighting devices. A light shade (not shown) can be installed over the display to block sunlight or artificial light from "washing out" the light produced by the lighting devices.

The down marker 200 can include a battery or battery pack (not shown) for providing power to the array of SSL devices and other electrical components. In one embodiment, the battery or battery pack can provide 3-10 volts of DC power to the down marker. For example, four 1.2V DC 4500 mA batteries can be used to make a 4.8VDC battery pack. A corresponding battery charger can be included with the down marker for charging the batteries. The battery charger can include an AC to DC adaptor.

Figure 4:
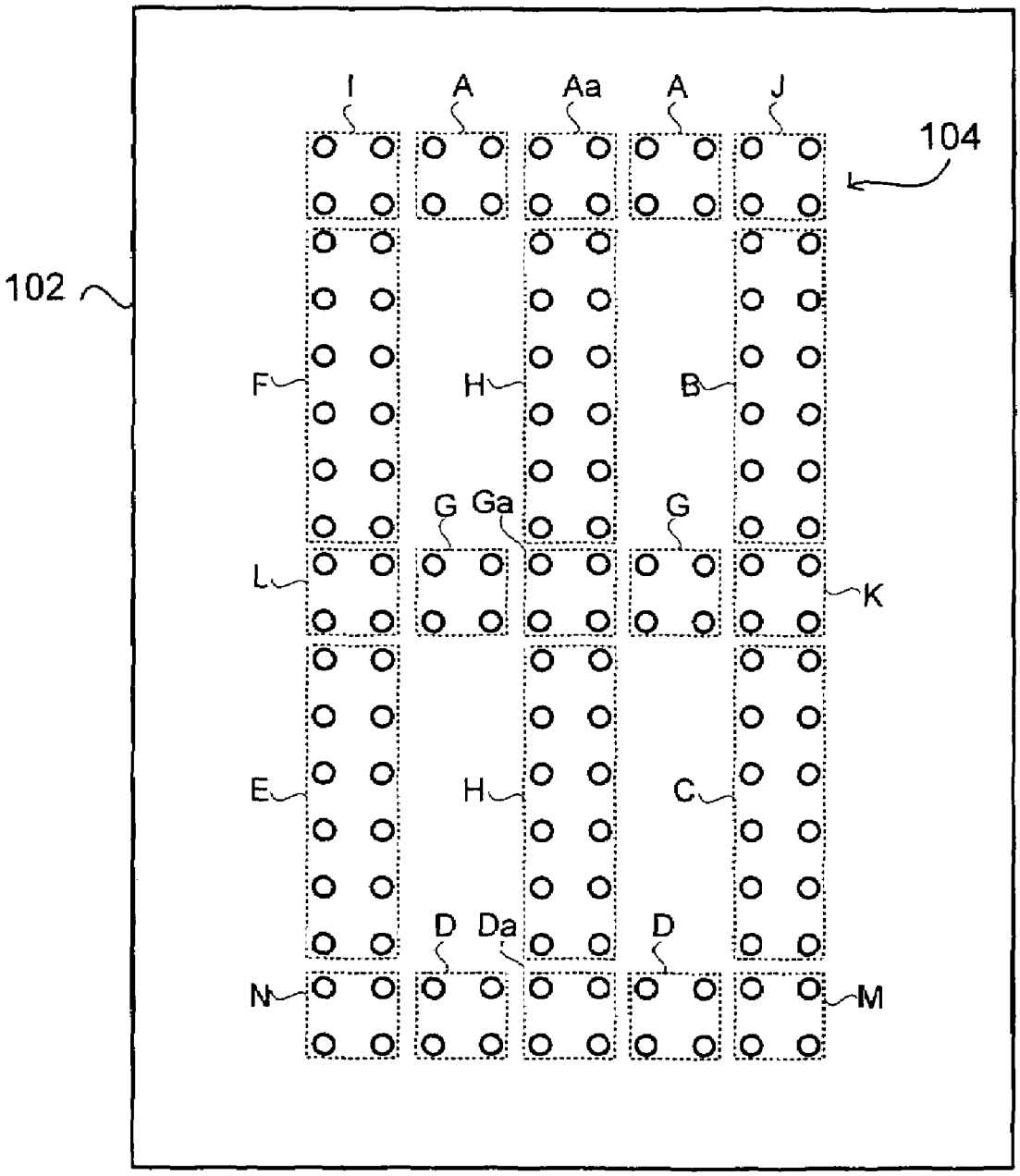
FIG. 4 is a front view of a down marker display panel and solid state lighting device array in accordance with an embodiment of the present invention.

The display panel 202 can carry an array of SSL devices 104 that are configured to optically display a down number. By varying the number of SSL devices included in the array, and their positioning configuration, as well as the overall size of the array, a variety of display arrangements, number fonts and number sizes can be created to optically display the current down number. As such, these various arrangements and sizes can be used to create the array of SSL devices according to the present invention, as will be apparent to one of skill in the art. One such arrangement is shown in FIG. 4, which will be described in detail below. According to one aspect, two arrays of SSL devices can be carried by the display panel for displaying current down information on both the front and the rear faces of the display panel.

The SSL device array can include, without limitation, light emitting diodes, organic light emitting diodes, polymer light-emitting diodes, and other such devices that emit light from a solid component. In addition to, or complementary to, the solid state lighting devices, the lighting devices can be formed wholly or partially from electroluminescent devices. Electroluminescent devices generally include a phosphorescent material which emits light when exposed to a small electrical current.

The structural and functional properties of solid state lighting devices provide benefits to a football down marker application that conventional lighting devices fail to provide. For example, traditional incandescent light bulbs and fluorescent/neon lamps are fragile and can be easily broken if used on the sideline of a football game. The power required by incandescent and fluorescent bulbs is also greater due to the fact that these light sources produce more wasted, non-visible radiation, such as heat, than do SSL devices.

In addition, the power requirements for a down marker having an array of incandescent lights is generally thought to be too large for a lightweight battery or battery pack suitable for use with portable down markers. If a down marker were provided with incandescent lighting, it may require a power cord or large batteries that could restrict the mobility of the down marker. In contrast, SSL devices require substantially less power and are less likely to fail or break than traditional lighting devices.

Because the compact SSL devices provide high light intensity with low power consumption, a relatively lightweight battery can be carried with the down marker to supply the device with sufficient power to function for an entire football game. An array of electronic features/devices can be added to the down marker to enhance sideline official performance. Such features could include, without limitation, a microphone, radio, display screens, cameras, and the like. One such feature, a wireless communication device, will be described in greater detail below.

The array of SSL devices can be selectively controlled by a control (shown schematically at 203 in FIG. 2) that can be carried by the down marker 200. A user can selectively manage the SSL device array by activating a unit 208 and 209 (e.g., a switch or button) that can provide external input to the control. The control can be a microprocessor or microcontroller that is programmed to perform a specific number of tasks. Various hardware devices, such as an erasable programmable read-only memory (EPROM) chip having a firmware program, a field programmable gate array (FPGA), or other similar device can be used as a control for the down marker.

According to one aspect of the invention, the control 203 can manage the refresh rate of the SSL devices, or the number of times per second the SSL devices are illuminated. As opposed to incandescent light bulbs, SSL devices can be turned on and off rapidly without damaging the device. Varying the refresh rate or "scanning" the SSL devices rather than continuously leaving them on increases the battery life and extends the period of usage for the down marker. When a user/designer increases the duty cycle of the scan, the overall brightness of the SSL device increases, and vice versa. Accordingly a scan rate control device (not shown) can be carried by the down marker 200, or can be incorporated into the control 203. This process, also known as Pulse Width Modulation (or "PWM") can be used to not only vary the intensity of the light produced by the present device, it can also increase battery life.

Figure 3:
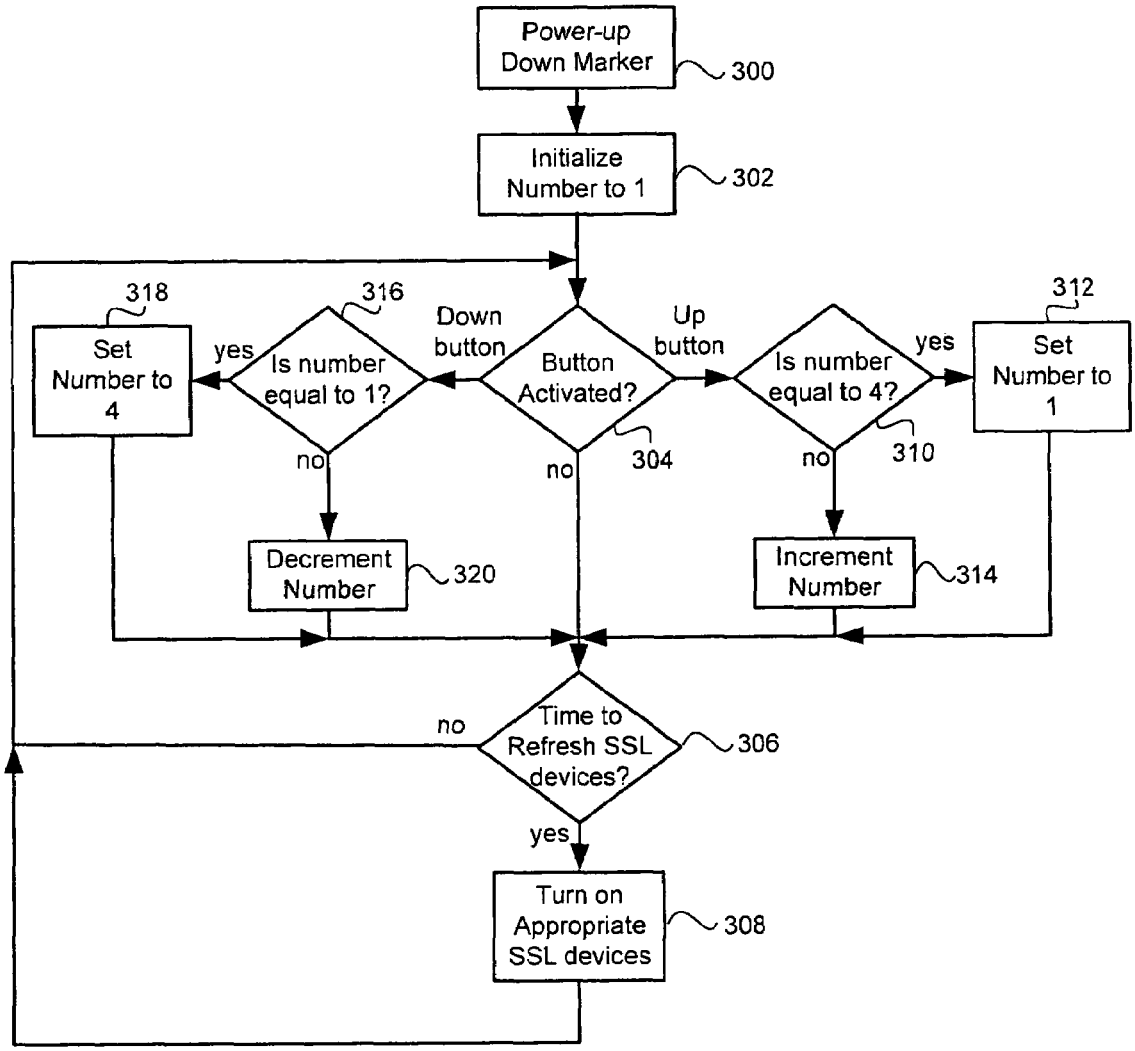
FIG. 3 is a flowchart illustrating control logic flow of a football down marker in accordance with an embodiment of the present invention.

FIG. 3 illustrates one exemplary embodiment of the control logic flow of the invention. This logic flow can be implemented with a variety of the embodiments described above, for example with a firmware program on a microprocessor. Beginning at step 300, a user can power up the device, which initializes, at 302, the display to "1." At 304, the control can check the state of the user input. The user input can include: a current down data that is received via a receiver from a remote transmission device; a unit that can be activated such as a button, a switch, or a dial; or some other user input device that will be apparent to one of ordinary skill in the art. However, for exemplary purposes, a button will be discussed, with the understanding that a variety of devices can be used to allow user input.

In the case where no button is activated, the control can check at 306 an internal clock/timer to see if it is time to refresh the display of the SSL devices. If it is appropriate to do so, the control's refresh routine is executed at 308 and the appropriate SSL devices are activated and the process begins again. If it is not time to refresh, then the process begins again at 304. If a button is activated, the control determines which button was activated, e.g., the "up" button or the "down" button. If the "up" button is activated, the process checks at 310 to see which down number is currently being displayed. If the down number displayed is "4," the control can set this number back to "1" at 312 and then moves to the step of checking the refresh timer/clock at 306. If the down number displayed is not "4," then the control increments the displayed down number by one digit.

In the case where the "down" button is activated, the control determines at 316 which down number is currently being displayed. If the down number displayed is "1," the processor can set this number to "4" at 318. Otherwise, the control decrements the down number displayed at 320 by one digit.

FIG. 4 illustrates an array of SSL devices 104 arranged on a display panel 102, according to an exemplary embodiment of the invention. The array shown includes 17 segments: A, Aa, B, C, D, Da, E, F, G, Ga, H, I, J, K, L, M, and N. Each segment can be selectively activated (e.g., the SSLs of each segment can be lit), either independently or together, by the control to display a desired down number.

The following table, Table 1, illustrates how the numbers can be created using the segments of FIG. 4. An "X" represents a segment that is activated and an empty box represents a segment that is not activated, or is in an "off" condition. For example, to display the number "1", the segments Aa, Da, Ga, and H can be activated and continually refreshed. Alternatively, to display the number "2", the segments A, Aa, B, D, E, G, Ga, I, J, K, L, M, and N can be activated. The numbers "3" and "4" can likewise be displayed according to the table and figure.

TABLE 1

| | A | Aa | B | C | D | Da | E | F | G | Ga | H | I | J | K | L | M | N |
|---|---|---|---|---|---|---|---|---|---|---|---|---|---|---|---|---|---|
| 1 | | X | | | | X | | | | X | X | | | | | | |
| 2 | X | X | X | | X | | X | | X | X | | X | X | X | X | X | X |
| 3 | X | X | X | X | X | X | | | X | X | | X | X | X | | X | X |
| 4 | | | X | X | | | | X | X | X | | X | X | X | X | X | |

Figure 5:
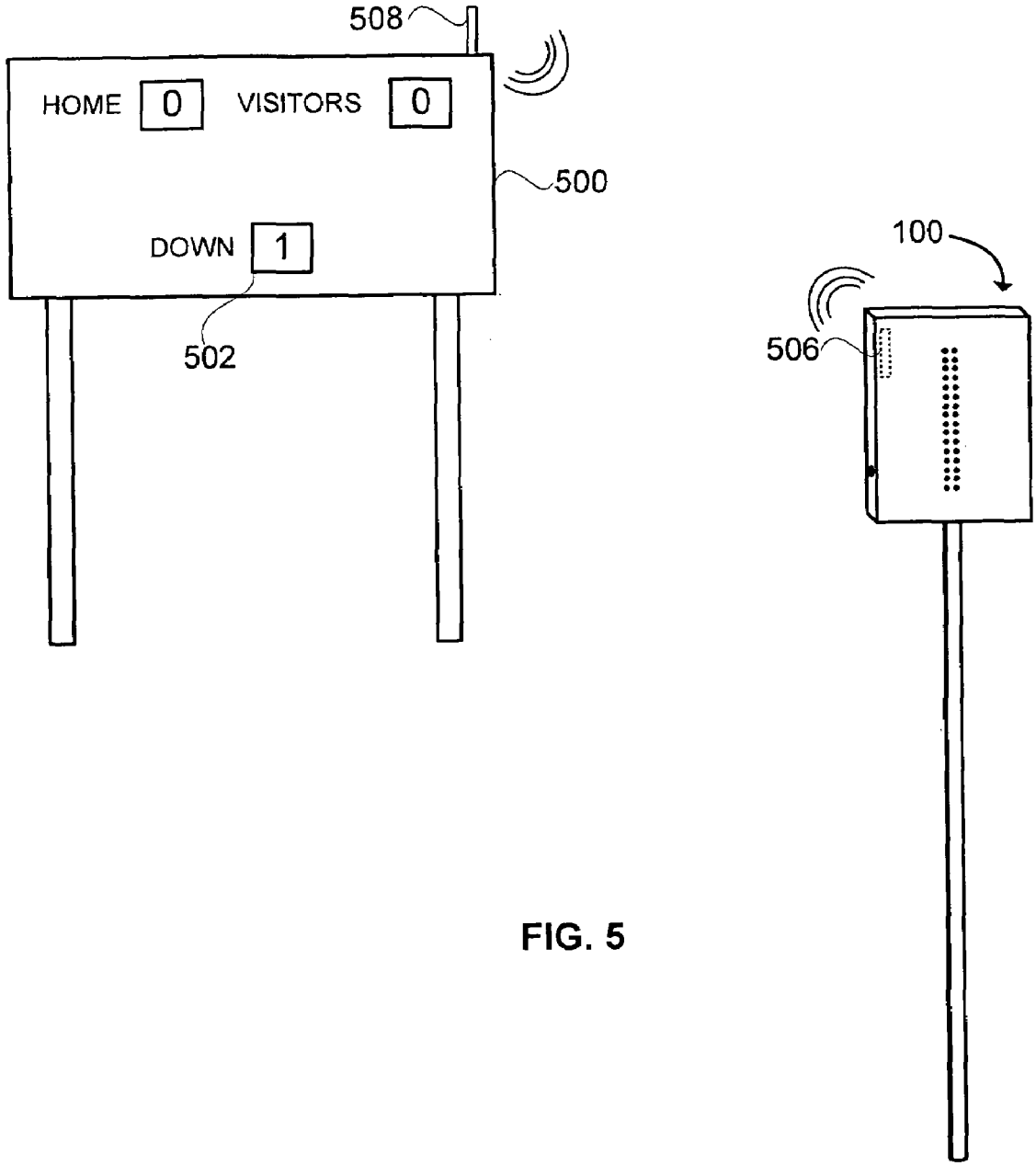
FIG. 5 is a schematic illustration of a football down marker and scoreboard system in accordance with an embodiment of the present invention.

As illustrated in FIG. 5, in one aspect of the invention, the down marker 100 can include a wireless communication device 506 associated with the down marker. The wireless communication device can be operable to transmit down information, or other game play information, between the down marker and a scoreboard device 500 to enable synchronization of the down information or the game play information between the down marker and the scoreboard device. The scoreboard device can be a scoreboard having a scoreboard wireless communication device 508 and a down indicator 502. The communication device can be configured to transmit data modulated using various modulating schemes including, without limitation: a modulation scheme standardized under IEEE 802, ASK modulation, FSK modulation, PSK modulation, AM modulation, and FM modulation.

The wireless communication 506, 508 devices can each include an antenna, transceiver, modulator, and/or other such communication device, as will be apparent to one of skill in the art for wirelessly transmitting and receiving the aforementioned modulated signals. An internal and/or external wireless communication device can also be incorporated into the present invention. As shown, the scoreboard system has an external antenna for transmitting and receiving, while the down marker has an internal antenna and wireless communication device.

By utilizing an electronic down marker, wireless communication is more easily integrated into the down marker than with conventional mechanical down markers. This feature of the invention can advantageously aid in synchronizing the scoreboard with the down marker (as well as synchronizing the down marker with the scoreboard). Additionally, other game information, such as picture, video, audio information, etc., can be communicated via the wireless communication device.

Figure 6:
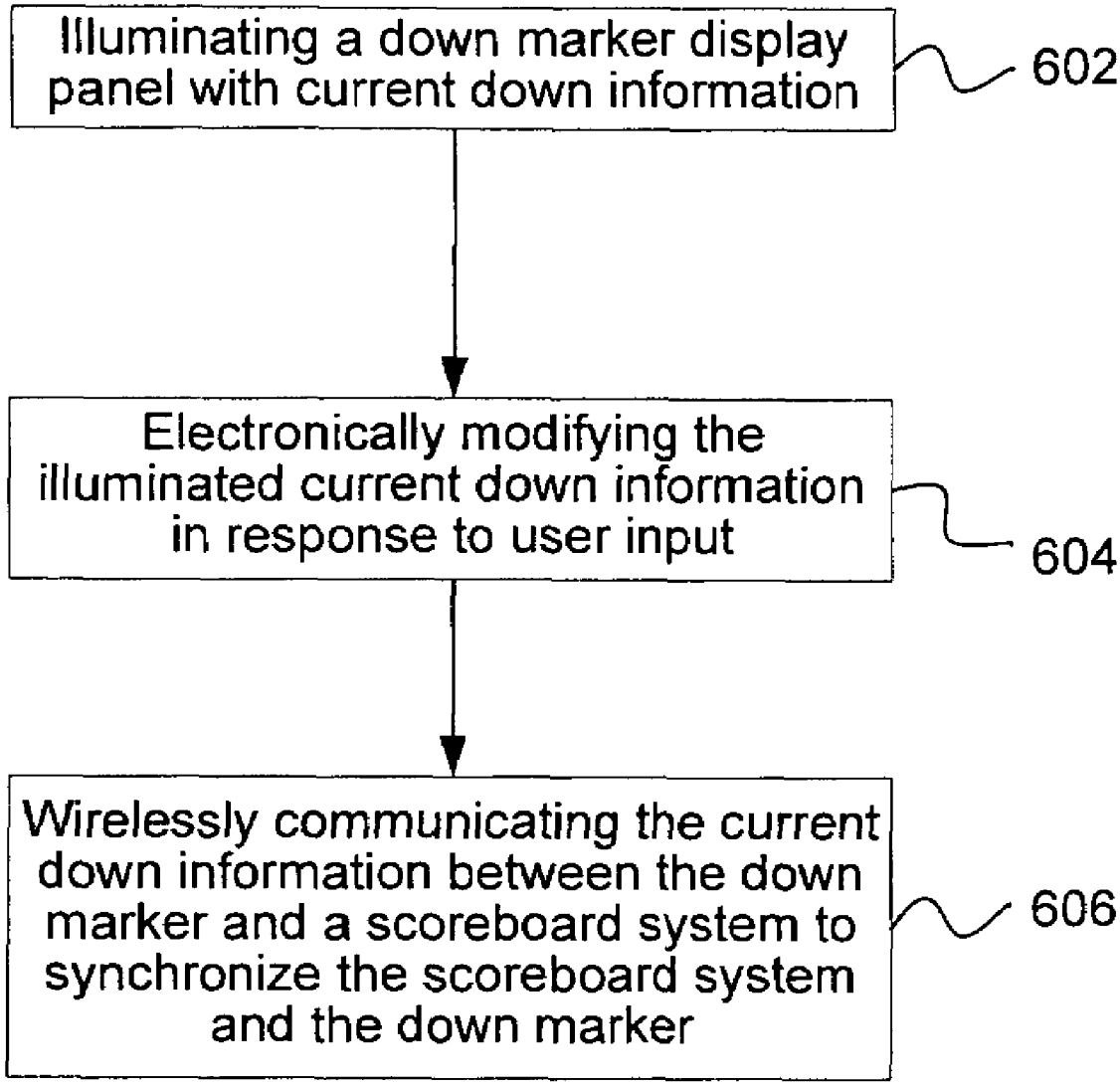
FIG. 6 is flowchart illustrating a method for displaying the current down in a football game, in accordance with an embodiment of the present invention.

A method for displaying the current down in a football game is shown in FIG. 6. The method can include: illuminating at 602 a down marker display panel with current down information. As explained above, this process can include constantly illuminating an array of SSL device, as well as periodically refreshing such an array. At 604, this current down information can then be modified in response to user input. At 606, by wirelessly communicating the current down information between the down marker and a scoreboard system, the two systems can be synchronized.

As will be appreciated from the foregoing, benefits of the present invention include a lightweight, easily operated and highly visible electronic down marker. Various embodiments of the down marker are suitable for providing additional utility over traditional mechanical down marker devices. Improved visibility is achieved by utilizing an array of SSL devices that can be visible in poor lighting conditions and from distant stadium seats. Wireless communication between the scoreboard and down marker systems can enhance game flow by reducing confusion on the field and in the stands.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

We claim:

1. A down marker for use in a football game, comprising:

a vertical support;

a display panel, extending from the vertical support;

an array of solid state lighting devices carried by the display panel, the array being configured to optically display a down number;

a control, associated with the down marker and being operable to enable selective control of the solid state lighting devices of the array in response to external input;

a stand having a bore configured to receive a bottom portion of the vertical support to maintain the down marker in an upright position; and a wireless communication device associated with the down marker and being operable to transmit down information or game play information between the down marker and a scoreboard device to enable synchronization of down information or game play information between the down marker and the scoreboard device.

2. The down marker of claim 1, wherein the solid state lighting devices include light emitting diodes.

3. The down marker of claim 1, wherein the stand is a weighted stand.

4. The down marker of claim 1, wherein the display panel further comprises a protective shield having a translucent plastic lens that is coupled to the display panel.

5. The down marker of claim 3, wherein the translucent plastic lens is tuned to a color of light emitted from the solid state lighting devices.

6. The down marker of claim 1, wherein the control includes a microprocessor having a firmware programs.

7. The down marker of claim 6, wherein the microprocessor is operable to control a refresh rate of the solid state lighting devices.

8. The down marker of claim 7, further comprising means, associated with the down marker, for re-charging a battery.

9. The down marker of claim 1, further comprising a battery operably coupled to the control.

10. The down marker of claim 1, wherein the display panel carries two arrays of solid state lighting devices to optically display a down on a front and a rear side of the display panel.

11. A down marker for use in a football game, comprising:

a vertical support;

a display panel, extending from the vertical support;

an array of solid state lighting devices carried by the display panel, the array being configured to optically display a down in response to external input; and a wireless communication device associated with the down marker and being operable to transmit down information or game play information between the down marker and a scoreboard device to enable synchronization of down information or game play information between the down marker and the scoreboard device.

12. The down marker of claim 11, wherein the wireless communication device is configured to transmit data modulated from the group of modulating schemes consisting of: a modulation scheme standardized under IEEE 802, ASK modulation, FSK modulation, PSK modulation, AM modulation, and FM modulation.

13. The down marker of claim 11, wherein the solid state lighting devices include light emitting diodes.

14. A method for displaying the current down in a football game, comprising:

illuminating a down marker display panel with current down information;

electronically modifying the illuminating current down information in response to user input; and wirelessly communicating the current down information between the down marker and a scoreboard systems to synchronize the scoreboard system and the down marker.

15. The method of claim 14, wherein wirelessly communicating the current down information comprises synchronizing the scoreboard with the down marker.

16. The method of claim 14, wherein wirelessly communicating the current down information comprises synchronizing the down marker with the scoreboard.

17. The method of claim 14, wherein illuminating the down marker comprises illuminating an array of solid state lighting devices.

18. The method of claim 14, wherein the user input comprises activating a unit on the down marker.

19. The method of claim 14, wherein the user input comprises receiving current down information via a receiver from a remote user transmission device.

* * * * *